US008148664B2

(12) United States Patent
Okumura et al.

(10) Patent No.: US 8,148,664 B2
(45) Date of Patent: Apr. 3, 2012

(54) GLOW PLUG AND MANUFACTURING METHOD OF THE SAME

(75) Inventors: Yuki Okumura, Nagoya (JP); Shuei Ishii, Suzaka (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 852 days.

(21) Appl. No.: 12/245,258

(22) Filed: Oct. 3, 2008

(65) Prior Publication Data

US 2009/0090705 A1 Apr. 9, 2009

(30) Foreign Application Priority Data

Oct. 5, 2007 (JP) ..... 2007-261844

(51) Int. Cl.
*F23Q 7/22* (2006.01)
*H05B 3/00* (2006.01)

(52) U.S. Cl. ..... 219/270; 29/611

(58) Field of Classification Search ..... 219/270, 219/260–269; 123/179.6; 29/611
See application file for complete search history.

(56) References Cited

U.S. PATENT DOCUMENTS 4,281,451 A 8/1981 Mann
5,251,589 A * 10/1993 Duba et al. ..... 123/145 A
5,783,801 A 7/1998 Riti et al.
6,037,568 A * 3/2000 Hatanaka et al. ..... 219/270
6,667,463 B2 12/2003 Terada
2009/0184101 A1* 7/2009 Hoffman et al. ..... 219/270
2010/0133252 A1* 6/2010 Abe ..... 219/270

FOREIGN PATENT DOCUMENTS

JP 2003017230 1/2003

* cited by examiner

*Primary Examiner* — Daniel L Robinson
(74) *Attorney, Agent, or Firm* — Stites & Harbison PLLC; Jeffrey A. Haeberlin

(57) ABSTRACT

A sheath heater for a glow plug comprises a sheath tube having a closed front end portion, and an open rear end portion. An insulating powder is charged into a gap between the sheath tube and a heat-generating resistor disposed within the sheath tube. A seal member includes an expanded portion extending radially outwardly from an outer circumference of the seal member, and a non-expanded portion of a smaller outside diameter than the expanded portion and formed on the outer circumference of the seal member at least at a leading end of the seal member. The seal member is fitted into the open rear end portion of the sheath tube such that the leading end enters the sheath tube first. The sheath tube is deformed radially inwardly around the seal member for sealing the heat-generating resistor and the insulating powder contained in the sheath tube.

8 Claims, 14 Drawing Sheets

DIAMETER-REDUCING STEP

DISPOSING STEP

CHARGING STEP

MOVING STEP

FITTING STEP

DIAMETER-REDUCING STEP

GLOW PLUG AND MANUFACTURING METHOD OF THE SAME

BACKGROUND OF THE INVENTION

1. Field of the Invention

The present invention relates to a glow plug used to assist in starting a diesel engine and to a method of manufacturing the same.

2. Description of Related Art

As an example glow plug used to assist in starting a diesel engine, a glow plug using a sheath heater is known. The sheath heater is configured as follows: a heat-generating coil is accommodated within a bottomed sheath tube having a closed front end, and a magnesia powder serving as an insulating powder is charged into the sheath tube so as to electrically insulate the heat-generating coil and the sheath tube from each other. The sheath heater is held in an axial bore of a tubular metallic shell such that its front portion projects from the metallic shell, whereas its rear portion is surrounded by a wall of the axial bore. The metallic shell and the sheath tube are electrically connected to each other. One end of the heat-generating coil is electrically connected to an inner surface of the sheath tube, and the other end of the heat-generating coil is electrically connected to one end of an axial rod, which is inserted into the axial bore of the tubular metallic shell while being electrically insulated from the metallic shell. When electricity is conducted between the metallic shell and the other end of the axial rod exposed from a rear end of the metallic shell, the heat-generating coil generates heat.

In the process of manufacturing such a glow plug, in order to seal a magnesia powder which is charged into the sheath tube as mentioned above, a seal member (elastic packing) formed of heat-resistant silicone rubber, fluorine-containing rubber, or the like is fitted into a rear end portion of the sheath tube. Subsequently, swaging or a like process is carried out on the sheath tube so as to diameter-reduce at least the rear end portion of the sheath tube, whereby an outer circumferential surface of the seal member and an inner circumferential surface of the sheath tube come into close contact with each other, thereby establishing a sealed condition (refer to, for example, Japanese Patent Application Laid-Open No. 2003-17230).

However, when the amount of the magnesia powder charged into the sheath tube is excessively large, or when the sheath tube is influenced by vibration generated in the course of swaging, the magnesia powder may intrude into a region between the inner circumferential surface of the sheath tube and the outer circumferential surface of the seal member. This may cause moisture in an ambient atmosphere to enter the sheath tube via the intruding magnesia powder. When the entry of moisture induces generation of gas from heat of the heat-generating coil, there is risk of deforming the sheath tube and rendering the heat-generating coil fragile.

BRIEF SUMMARY OF THE INVENTION

The present invention has been conceived for solving the above-mentioned problems, and an object of the invention is to provide a glow plug in which an insulating powder charged into a sheath tube can be reliably sealed, as well as a method of manufacturing the same.

According to a first aspect of the invention, a glow plug has a sheath heater. The sheath heater comprises: a sheath tube extending in an axial direction and having a tubular shape, a closed front end portion, and an open rear end portion; a heat-generating resistor disposed within the sheath tube; an insulating powder charged into a gap between the sheath tube and the heat-generating resistor; and a seal member received in the sheath tube and having a substantially cylindrical shape, the seal member including an expanded portion extending radially outwardly from an outer circumference of the seal member, and a non-expanded portion of a smaller outside diameter than the expanded portion at least prior to receipt of the seal member in the sheath tube, and formed on the outer circumference of the seal member at least at a leading end of the seal member; the seal member being fitted into the open rear end portion of the sheath tube such that the leading end enters the sheath tube first, and the sheath tube being deformed radially inwardly around the seal member for sealing the heat-generating resistor and the insulating powder contained in the sheath tube. The sheath heater generates heat through conduction of electricity to the heat-generating resistor.

The seal member has the expanded portion and the non-expanded portion which are formed on its outer circumference. Thus, in the course of the seal member being fitted into the sheath tube, the expanded portion frictionally slides on the inner circumferential surface of the sheath tube, whereby the expanded portion can scrape off adhering insulating powder from the inner circumferential surface. Further, since the seal member has the non-expanded portion, in the course of the seal member being fitted into the sheath tube, the entire outer circumferential surface of the seal member does not come into contact with the inner circumferential surface of the sheath tube. Accordingly, contact resistance associated with fitting work can be lowered, so that the seal member can be readily fitted into the sheath tube. Also, since the non-expanded portion is provided at least on a side toward the front end of the seal member, at the beginning of fitting the seal member into the sheath tube, the seal member can be less likely to be caught by an opening portion of the sheath tube, so that the seal member can be readily fitted into the sheath tube. Further, when the diameter of the sheath tube is reduced by swaging or a like process, the insulating powder is pressed in the rear end portion of the sheath tube and may intrude into a region between the sheath tube and the sealing member. Even in such a case, since the expanded portion in close contact with the inner circumferential surface of the sheath tube checks the flow of the insulating powder, the insulating powder does not reach the opening of the sheath tube. Accordingly, there is not formed a channel of the insulating powder through which moisture or the like is transmitted to the interior of the sheath tube.

In one embodiment, the expanded portion is circumferentially continuous on the outer circumference of the seal member, thereby assuming an annular form. Thus, the expanded portion can be brought in contact with the sheath tube along the entire inner circumference of the sheath tube. Thus, the insulating powder can be reliably sealed.

In another embodiment, the expanded portion and the non-expanded portion are formed on the outer circumference of the seal member such that a shape of the seal member has mutually corresponding regions on axially opposite sides of an axially central position of the seal member with respect to the axial direction. Therefore, the seal member can be fitted into the sheath tube without need to consider from which axial end of the seal member the seal member is to be fitted. This eliminates the trouble of orienting the seal member in a manufacturing process, whereby production cost can be lowered.

In yet another embodiment, a distance which the non-expanded portion occupies along the outer circumference of the seal member in an axial direction is greater than another distance which the expanded portion occupies along the outer circumference of the seal member in the axial direction. Thus, in the course of fitting the seal member into the sheath tube, a portion of the seal member in contact with the inner circumferential surface of the sheath tube can be reduced, whereby contact resistance can be lowered, and thus fitting work can be facilitated. Meanwhile, when a diameter of a rear end portion of the sheath tube is reduced, the expanded portion of the seal member is pressed by the inner circumferential surface of the rear end portion of the sheath tube and is thus deformed. However, by means of the distance occupied by the expanded portion being rendered smaller than the distance occupied by the non-expanded portion as mentioned above, the ratio of the expanded portion to the entire seal member can be rendered low. Therefore, the amount of deformation of the seal member is relatively small. That is, an increase in internal stress of the seal member associated with deformation can be restrained, so that a sealed condition can be maintained stably.

According to a second aspect of the invention, a method of manufacturing a glow plug includes: a charging step of charging an insulating powder into a sheath tube from an opening of a rear end portion of the sheath tube, where a heat-generating resistor is disposed within the sheath tube, the rear end portion of the sheath tube having an inside diameter A; a fitting step of inserting a seal member having elastic properties into the sheath tube from the opening of the rear end portion of the sheath tube, the seal member including an expanded portion extending radially outwardly from an outer circumference of the seal member, and a non-expanded portion formed on the outer circumference of the seal member at least at a leading end of the seal member, wherein, at least prior to inserting the seal member into the sheath tube, the expanded portion has an outside diameter B and the non-expanded portion has an outside diameter C, wherein $C<A<B$, such that the expanded portion frictionally slides on an inner circumferential surface of the rear end portion of the sheath tube; and a diameter-reducing step of deforming at least the rear end portion of the sheath tube radially inwardly so as to render the inside diameter A of the rear end portion smaller than the outside diameter C of the non-expanded portion of the seal member.

Since the seal member is formed beforehand such that the inside diameter A of the rear end portion of the sheath tube, the outside diameter B of the expanded portion of the seal member, and the outside diameter C of the non-expanded portion of the seal member satisfy the relation $C<A<B$, in the fitting step, a clearance can be reliably provided between the inner circumferential surface of the rear end portion of the sheath tube and the non-expanded portion of the seal member, whereby the seal member can be readily fitted into the sheath tube. Also, the expanded portion of the seal member can be reliably brought into contact with the inner circumferential surface of the sheath tube. Further, in the course of fitting work, the expanded portion can scrape off adhering insulating powder from the inner circumferential surface of the sheath tube. Thus, when the diameter of the rear end portion of the sheath tube is reduced, the insulating powder is not present in a region between the inner circumferential surface of the sheath tube and an outer circumferential surface of a portion of the seal member located rearward of the expanded portion, whereby the insulating powder can be reliably sealed.

In an embodiment of the second aspect of the invention, the seal member has an insertion hole extending through the seal member along the axial direction and having a diameter smaller than a diameter of an axial rod, for allowing the axial rod to be inserted through the insertion hole, the axial rod being a conductive rod extending in the axial direction and adapted to conduct electricity to the heat-generating resistor. The method further comprises: a disposing step performed before the charging step of disposing the heat-generating resistor and a front end portion of the axial rod within the sheath tube the front end portion of the axial rod, being electrically connected to a rear end of the heat-generating resistor, and a moving step performed between the charging step and the fitting step of inserting a rear end of the axial rod through the insertion hole of the seal member and moving the seal member toward the front end portion of the axial rod; and as measured after the moving step and before the fitting step, the inside diameter A of the rear end portion of the sheath tube whose diameter has not yet been reduced, the outside diameter B of the expanded portion of the seal member, and the outside diameter C of the non-expanded portion of the seal member satisfy a relation $C<A<B$.

Since the axial rod for conducting electricity to the heat-generating resistor is connected to the sheath heater, the seal member may have the insertion hole having a diameter smaller than that of the axial rod, for allowing the axial rod to be inserted through the insertion hole. In a condition where the axial rod is inserted through the insertion hole, the outside diameter of the seal member increases. Thus, by means of the relation $C<A<B$ being satisfied in a condition where the axial rod is inserted through the insertion hole of the seal member, while easiness of fitting the seal member into the sheath tube is maintained, the expanded portion of the seal member can be reliably brought into contact with the inner circumferential surface of the sheath tube.

Other features and advantages of the invention will be set forth in, or apparent from, the detailed description of the exemplary embodiments of the invention found below.

BRIEF DESCRIPTION OF THE SEVERAL VIEWS OF THE DRAWINGS

These and other features, aspects, and advantages of the present invention will become better understood with regard to the following description, appended claims, and accompanying drawings where:

DETAIL DESCRIPTION OF EXEMPLARY EMBODIMENTS OF THE INVENTION

Figure 1:
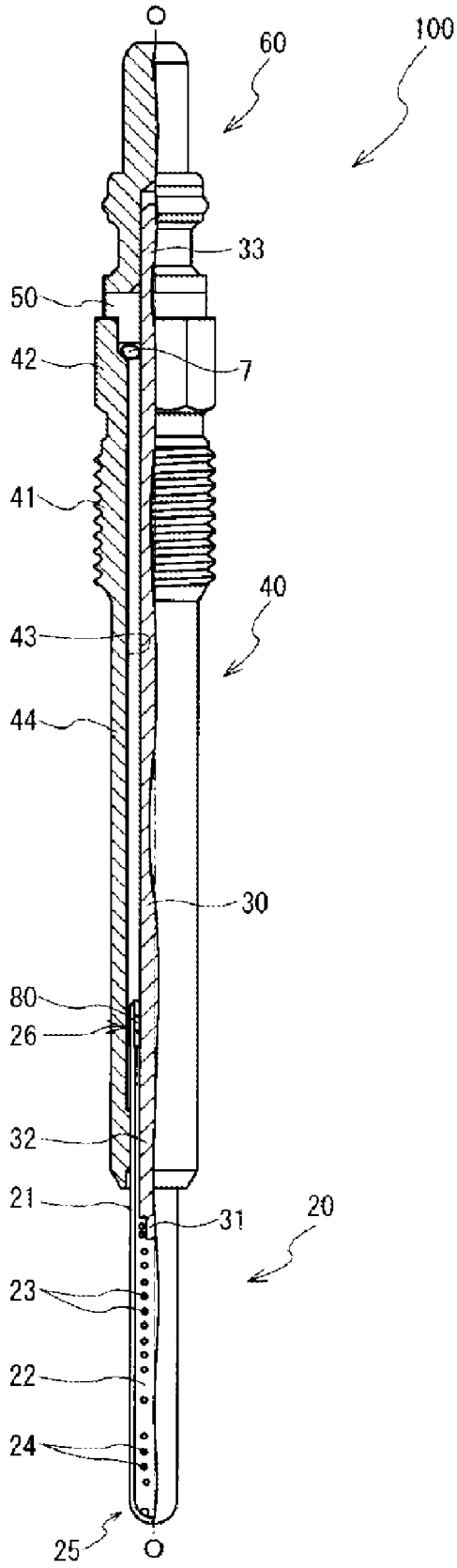
FIG. 1 is a vertical sectional view of a glow plug according to an exemplary embodiment of the invention.
Figure 2:
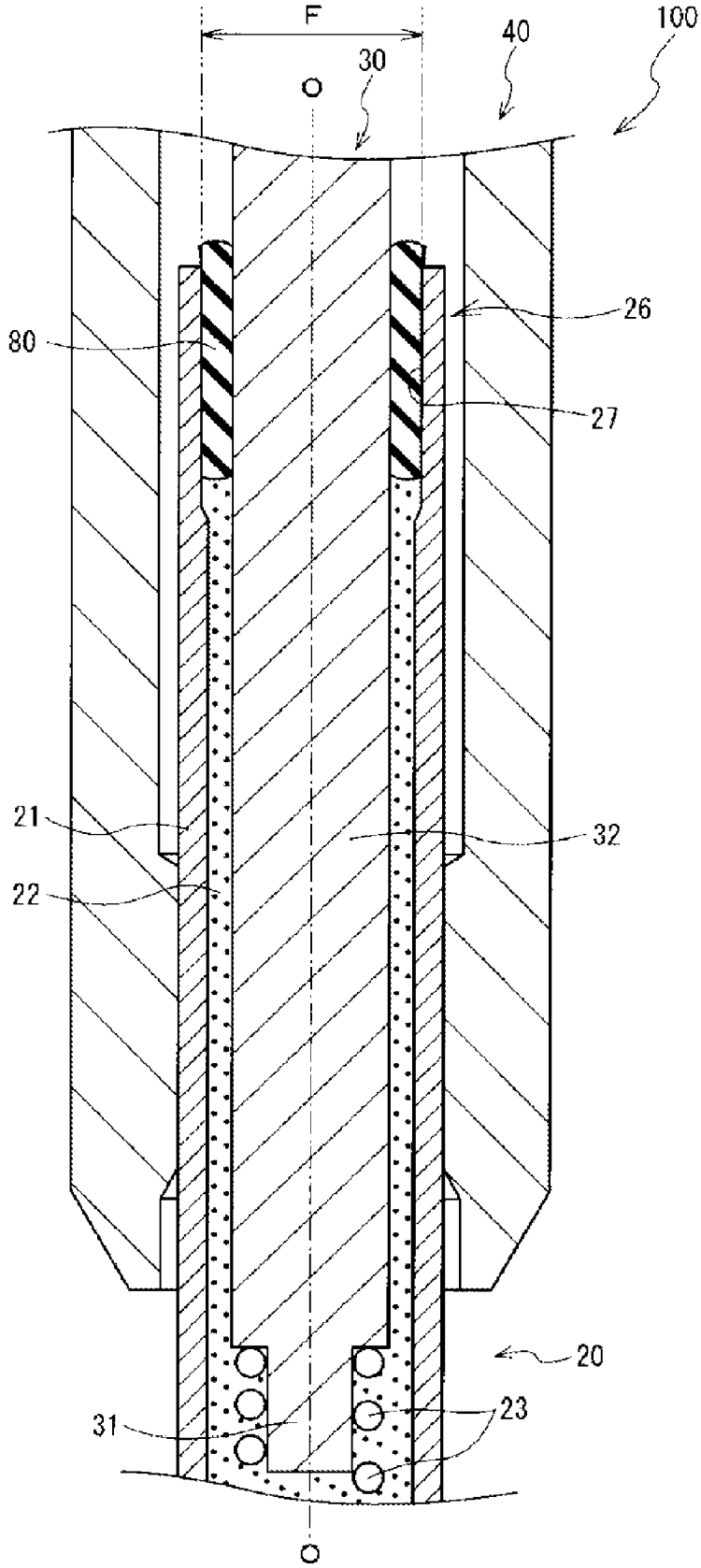
FIG. 2 is an enlarged sectional view of a rear end portion of a sheath heater.

An embodiment of a glow plug according to the present invention will next be described with reference to the drawings. The structure of an exemplary glow plug 100 will be described with reference to FIGS. 1 and 2. FIG. 1 is a vertical sectional view of the glow plug 100. FIG. 2 is a sectional view showing, on an enlarged scale, a rear end portion of a sheath heater 20. In the following description, a side toward the sheath heater 20 (the lower side in FIG. 1) along the direction of an axis O is referred to as a front side of the glow plug 100.

The glow plug 100 shown in FIG. 1 is mounted to, for example, a combustion chamber (not shown) of a direct-injection-type diesel engine and is utilized as a heat source for assisting ignition in starting the diesel engine. The glow plug 100 is a so-called sheath-type glow plug and has a structure in which a sheath heater 20 is held by a metallic shell 40. The sheath heater 20 is configured such that a heat-generating resistor (heat-generating coil 24) is disposed within a slender metal tube (sheath tube 21) having its one end closed.

First, the metallic shell 40 will be described. The metallic shell 40 is a slender, tubular metal member having an axial bore 43 which extends therethrough in the direction of the axis O. A trunk portion 44 of the metallic shell 40 has an externally threaded portion 41 located toward its rear end and adapted to be screwed into a mounting hole (not shown) of an engine head. Also, the metallic shell 40 has a tool engagement portion 42 located at its rear end and having a hexagonal cross section. When the metallic shell 40 is to be mounted to the engine head, a mounting tool is engaged with the tool engagement portion 42. The axial bore 43 of the metallic shell 40 has a substantially uniform diameter, except for a rear end portion whose diameter is increased so as to receive an insulation ring 50, which will be described later, and a front end portion whose diameter is slightly increased for facilitating insertion of the sheath heater 20, which is inserted into and held in the axial bore 43. An axial rod 30 is inserted into the axial bore 43.

Next, the axial rod 30 will be described. The axial rod 30 is a cylindrical metal rod extending in the direction of the axis O and formed of an iron-based material (e.g., Fe—Cr—Mo steel). The axial rod 30 is longer than the metallic shell 40 with respect to the direction of the axis O. The axial rod 30 has an engagement portion 31 formed at the front end of its front end portion 32 and having a diameter smaller than that of a trunk portion of the axial rod 30. An electrode of a control coil 23 of the sheath heater 20, which will be described later, is welded to the engagement portion 31 of the axial rod 30. A rear end portion 33 of the axial rod 30 projects rearward from the rear end of the metallic shell 40 and is fitted into a pin terminal 60, which will be described later.

Next, the sheath heater 20 will be described. The sheath tube 21 serves as an external wall of the sheath heater 20 and is a cylindrical tube formed of metal, such as a nickel alloy (e.g., INCONEL (trade name)) or stainless steel. The sheath tube 21 has a hemispherically closed front end portion 25, thereby assuming the form of a sheath. The sheath tube 21 contains the heat-generating coil 24 and the control coil 23, which are spirally coiled and are electrically conductive. The heat-generating coil 24 is formed of, for example, an Fe—Cr—Al alloy and generates heat when voltage is applied thereto. One electrode, at a front end of the heat-generating coil 24 is welded to the inner surface of the front end portion 25 of the sheath tube 21. The other electrode of the heat-generating coil 24 is joined to one electrode of the control coil 23. The control coil 23 is formed of, for example, a Co—Ni—Fe alloy and has such a characteristic that its resistance increases with temperature. Accordingly, as the temperature of the heat-generating coil 24 increases, the control coil 23 functions to reduce current which flows to the heat-generating coil 24. The other electrode of the control coil 23 is engaged with and welded to the engagement portion 31 of the axial rod 30, thereby being electrically connected to the axial rod 30.

The heat-generating coil 24, the control coil 23, and the front end portion 32 of the axial rod 30 are accommodated in the sheath tube 21. In this condition, as shown in FIG. 2, the sheath tube 21 is crimped from radially outside, thereby being diameter-reduced. At a rear end portion 26 of the sheath tube 21, a seal member 80, which will be described later, intervenes between an inner circumferential surface 27 of the rear end portion 26 of the sheath tube 21 and the outer circumferential surface of the axial rod 30, whereby the axial rod 30 and the sheath heater 20 are unitarily fixed while the sheath tube 21 and the axial rod 30 are insulated from each other. A magnesia powder 22 serving as an insulating powder is filled into the sheath tube 21 and is confined in the sheath tube 21 while being sealed by the seal member 80. As a result of the magnesia powder 22 being confined in the sheath tube 21 in a sealed condition, the heat-generating coil 24 and the control coil 23 are maintained in an insulated condition from the inner surface of the sheath tube 21, except for a portion welded to the inner surface.

Next, as shown in FIG. 1, the sheath heater 20 united with the axial rod 30 is press-fitted from its rear end portion 26 into the axial bore 43 of the metallic shell 40 from the front end of the metallic shell 40 and is fixedly positioned. In this condition, the axial rod 30 within the axial bore 43 of the metallic shell 40 is maintained in noncontact with the metallic shell 40. An annular O-ring 7 is fitted to a rear end portion of the axial rod 30 and is received in a diameter-increased rear end portion of the axial bore 43 of the metallic shell 40. Further, an annular insulation ring 50 is fitted to a rear end portion of the axial rod 30 and is fitted into the diameter-increased rear end portion of the axial bore 43 of the metallic shell 40, thereby pressing the O-ring 7 from the rear side. The O-ring 7 is in contact with the wall surface of the axial bore 43 of the metallic shell 40, the outer circumferential surface of the axial rod 30, and the front end surface of the insulation ring 50, thereby maintaining airtightness within the axial bore 43. The insulation ring 50 maintains the axial rod 30 in position in such a manner that the axial rod 30 and the wall of the axial bore 43 of the metallic shell 40 are in noncontact with each other to thereby reliably insulate the axial rod 30 and the wall of the axial bore 43 from each other.

Further, a pin terminal 60, which as a cap-like form, is fitted to the rear end portion 33 of the axial rod 30 projecting from the rear end of the insulation ring 50. While pressing the insulation ring 50 against the metallic shell 40, the pin terminal 60 is crimped from radially outside toward the rear end portion 33 of the axial rod 30. By this procedure, the sheath heater 20 and the axial rod 30 are fixedly positioned in relation to the metallic shell 40. When the glow plug 100 is mounted to an engine head (not shown), a plug cap (not shown) is fitted to the pin terminal 60 for supply of power.

Figure 3:
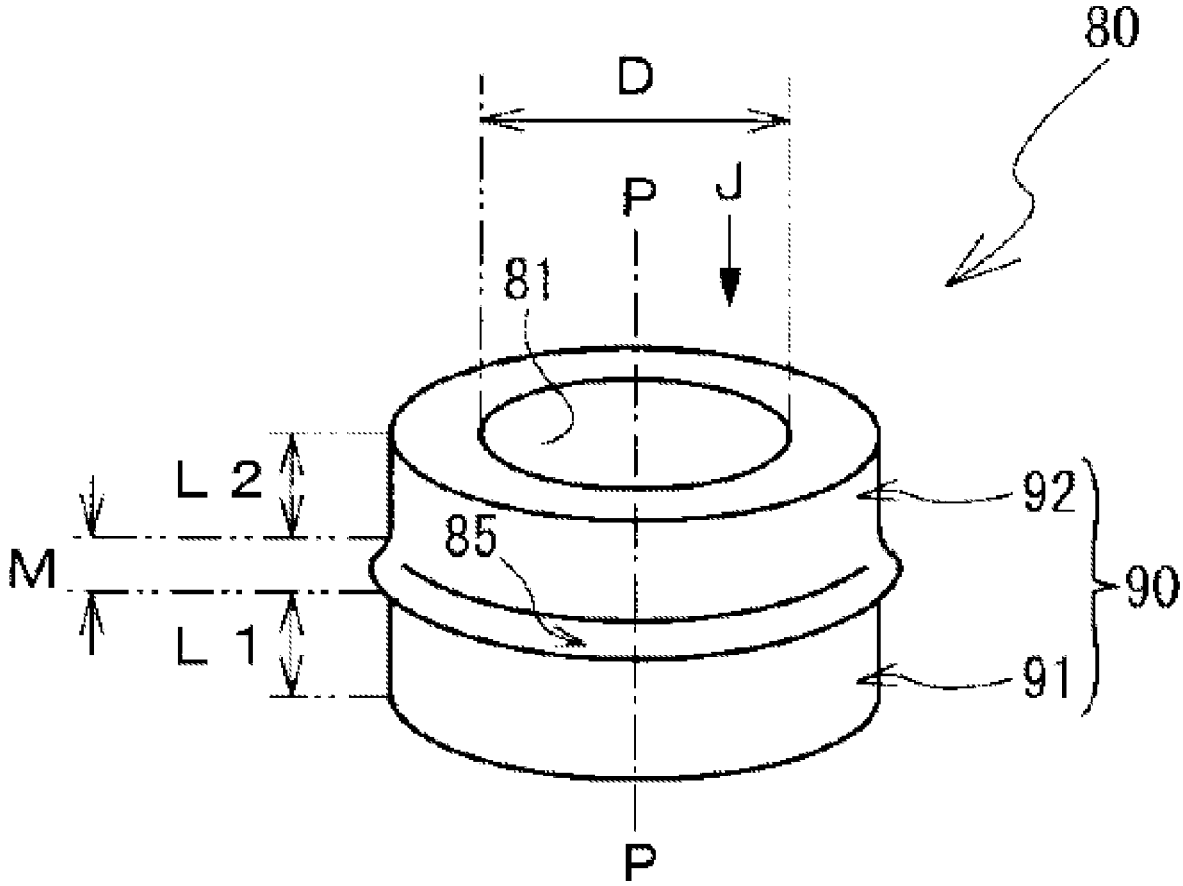
FIG. 3 is a perspective view of a seal member as viewed before being assembled to the glow plug.
Figure 4:
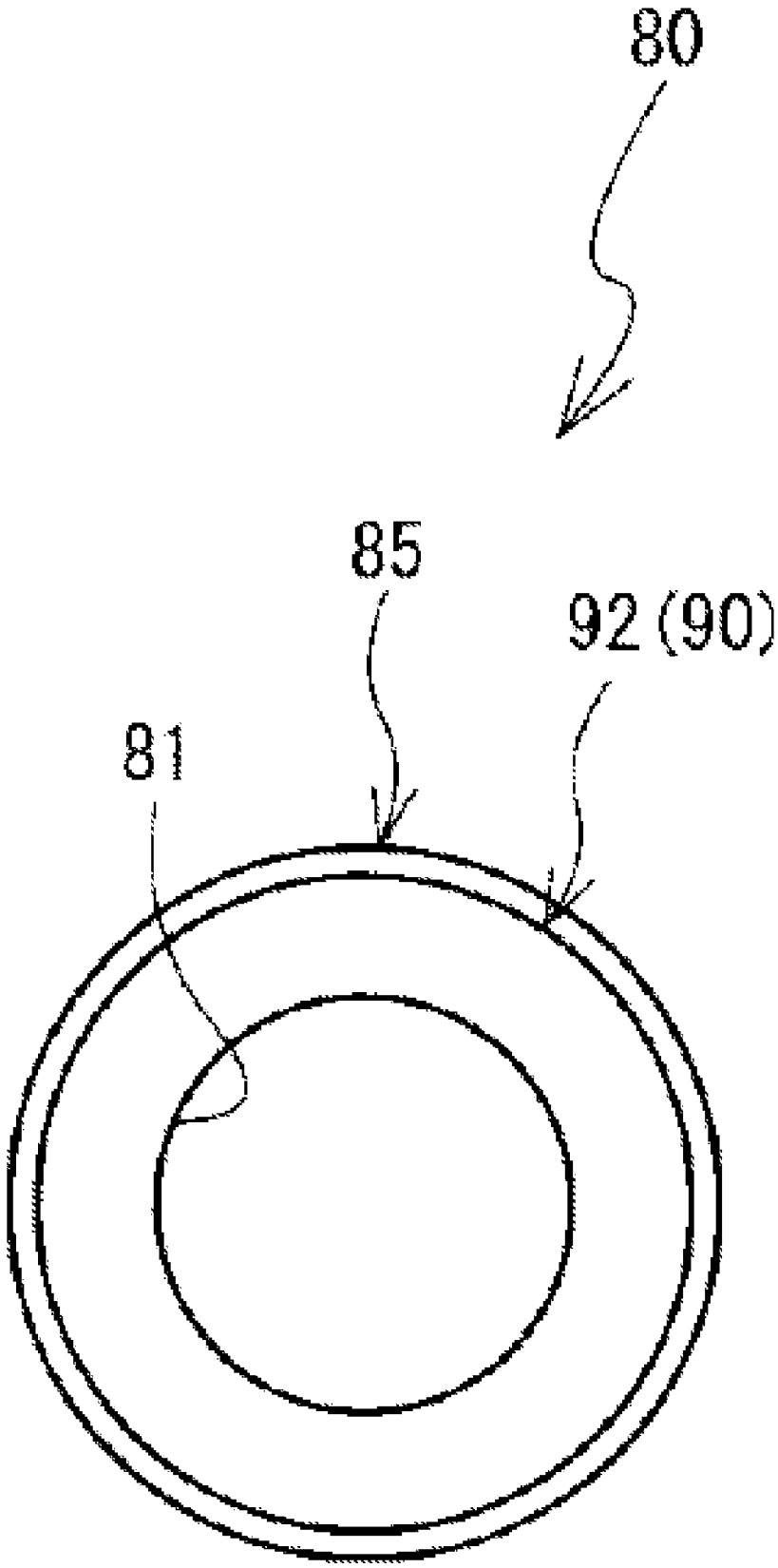
FIG. 4 is a view of the seal member of FIG. 3 as viewed in the direction of an arrow J along the direction of an axis P of an insertion hole of the seal member.
Figure 5:
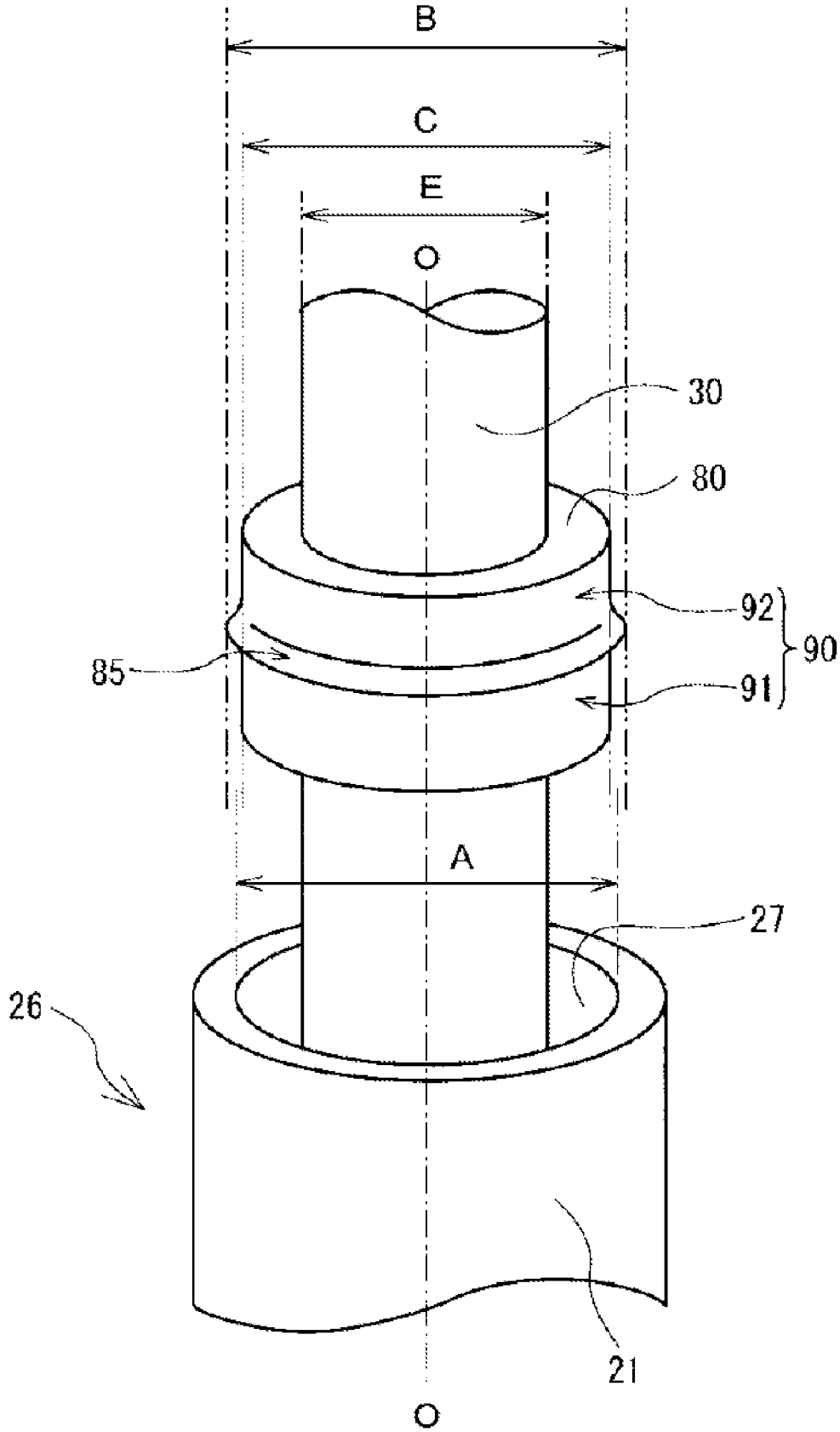
FIG. 5 is a perspective view showing a state in the process of manufacturing the glow plug, showing the relation of dimensional magnitude among the sheath tube and portions of the seal member.

Next, the seal member 80 will be described in detail with reference to FIGS. 3 to 5. FIG. 3 is a perspective view showing the appearance of the seal member 80 as viewed before being assembled to the glow plug 100. FIG. 4 is a view of the seal member 80 of FIG. 3 as viewed in the direction of an arrow J along the direction of an axis P of an insertion hole 81 of the seal member 80. FIG. 5 is a perspective view showing a state in the process of manufacturing the glow plug 100 for explaining the relation of dimensional magnitude among the sheath tube 21 and portions of the seal member 80.

The above-mentioned seal member 80 (see FIG. 2) is an elastic member formed of silicone rubber or fluorine-containing rubber, which exhibit high heat resistance and insulating performance. As shown in FIG. 3, the seal member 80 before being assembled to the glow plug 100 assumes a substantially cylindrical form or shape in which the insertion hole 81 extends therethrough along the axis P, which coincides with the axis O of the glow plug 100. The seal member 80 has a large-diameter portion 85 projecting radially outwardly from its outer circumferential surface. The large-diameter portion 85 and a small-diameter portion 90 smaller in diameter than the large-diameter portion 85 form a relief geometry on the outer circumferential surface of the seal member 80. In the present embodiment, as shown in FIG. 4, the large-diameter portion 85 is circumferentially continuous around the outer circumference of the seal member 80, thereby assuming an annular form; i.e., the large-diameter portion 85 assumes the form of a brim. The large-diameter portion 85 corresponds to the "expanded portion" in the present invention. The small-diameter portion 90 corresponds to the "non-expanded portion" in the present invention.

As shown in FIG. 3, as a result of formation of the large-diameter portion 85, the small-diameter portion 90 is divided into a front-end small-diameter portion 91, which comes on the front side (i.e., the leading end) at the time of assembly to the glow plug 100 (such that the leading end enters the sheath tube 21 first), and a rear-end small-diameter portion 92, which comes on the rear side at the time of assembly to the glow plug 100. The large-diameter portion 85 is formed at an axially central position of the seal member 80 with respect to the direction of the axis P. The front-end small-diameter portion 91 and the rear-end small-diameter portion 92 have the same diameter. Thus, the seal member 80 has mutually corresponding regions on axially opposite sides of the axially central position of the seal member 80 with respect to the direction of the axis P; i.e., substantially the same shape is imparted to the front side and the rear side which are located on axially opposite sides of the axially central position of the seal member 80 with respect to the direction of the axis P.

In order to reliably seal the magnesia powder 22 contained in the sheath tube 21 in the process of manufacturing the glow plug 100, the present embodiment prescribes the following relation of dimensional magnitude between the large-diameter portion 85 and the small-diameter portion 90 of the seal member 80. First, as shown in FIG. 3, as measured before the seal member 80 is assembled to the glow plug 100, the insertion hole 81 has a diameter D. As shown in FIG. 5, the axial rod 30 has an outside diameter E. At this time, a relation $D<E$ is satisfied. By virtue of this, during and after assembly of the glow plug 100, the wall surface of the insertion hole 81 of the elastic seal member 80 can come into close contact with the outer circumferential surface of the axial rod 30.

As shown in FIG. 5, as measured in a condition where the axial rod 30 is inserted through the insertion hole 81 of the seal member 80 (in a condition of the seal member 80 which is undergoing a moving step in the process of manufacturing the glow plug 100), the large-diameter portion 85 of the seal member 80 has an outside diameter B, and the small-diameter portion 90 of the seal member 80 has an outside diameter C. As measured before undergoing a diameter-reducing step, the rear end portion 26 of the sheath tube 21 has an inside diameter A. At this time, a relation $C<A<B$ is satisfied. That is, the outside diameter C of the small-diameter portion 90 of the seal member 80 is smaller than the inside diameter A of the sheath tube 21. Thus, in the course of fitting the seal member 80 into the sheath tube 21, contact resistance therebetween is lowered, so that the fitting work can be facilitated. Particularly, since the front-end small-diameter portion 91, which comes on the front side with respect to an inserting direction of the fitting work, is smaller in outside diameter than the large-diameter portion 85, at the beginning of the fitting work, the seal member 80 is less likely to be caught by a rear-end opening portion of the sheath tube 21. Also, in the course of the fitting work, the seal member 80 can be readily pushed into the sheath tube 21 until the large-diameter portion 85 of the seal member 80 comes into contact with the rear end of the sheath tube 21. As mentioned above, the seal member 80 has mutually corresponding regions on axially opposite sides of the axially central position of the seal member 80 with respect to the direction of the axis P; thus, the seal member 80 may be assembled to the glow plug 100 either with the front-end small-diameter portion 91 oriented frontward or with the rear-end small-diameter portion 92 oriented frontward. Therefore, trouble in the process of manufacture can be lessened.

Further, with respect to the direction of the axis P along the outer circumference of the seal member 80, the large diameter portion 85 occupies a length (range or distance) M; the front-end small-diameter portion 91 of the small-diameter portion 90 occupies another length (range or distance) L1; and the rear-end small-diameter portion 92 of the small-diameter portion 90 occupies another length (range or distance) L2. At this time, a relation $M<L1+L2$ is satisfied. That is, the length (range) M of the large-diameter portion 85, which frictionally slides on the inner circumferential surface 27 of the sheath tube 21 when the seal member 80 is fitted into the sheath tube 21, is rendered sufficiently small as compared with the length (range) of the seal member 80 along the direction of the axis P; i.e., as compared with $L1+M+L2$. By means of the large-diameter portion 85 and the small-diameter portion 90 satisfying such a dimensional relation, contact resistance between the seal member 80 and the inner circumferential surface 27 of the sheath tube 21 is lowered, whereby the fitting work can be facilitated.

Meanwhile, a clearance arises between the small-diameter portion 90 of the seal member 80 and the inner circumferential surface 27 of the sheath tube 21. However, since the outside diameter B of the large-diameter portion 85 of the seal member 80 is greater than the inside diameter A of the sheath tube 21, in the course of fitting the seal member 80 into the sheath tube 21, the large-diameter portion 85 can be reliably brought into contact with the inner circumferential surface 27 of the sheath tube 21, thereby eliminating formation of a clearance between the seal member 80 and the inner circumferential surface 27 of the sheath tube 21. Thus, even when the magnesia powder 22 intrudes into the clearance between the front-end small-diameter portion 91 of the small-diameter portion 90 of the seal member 80 and the inner circumferential surface 27 of the sheath tube 21 by the influence of vibration generated in the course of the seal member 80 being fitted into the sheath tube 21, the large-diameter portion 85 in close contact with the inner circumferential surface 27 restricts the flowable range of the magnesia powder 22. Therefore, the magnesia powder 22 does not reach a region associated with the rear-end small-diameter portion 92. Further, even when the magnesia powder 22 adheres to the inner circumferential surface 27 of the sheath tube 21, in the course of the seal member 80 being fitted into the sheath tube 21, the large-diameter portion 85 of the seal member 80 can scrape off the adhering magnesia powder 22 from the inner circumferential surface 27. This can prevent the magnesia powder 22 from intervening between the seal member 80 and the inner circumferential surface 27 of the sheath tube 21 continuously over a range from the front-end small-diameter portion 91 to the rear-end small-diameter portion 92.

Further, in the process of manufacturing the glow plug 100, which will be described later, the sheath tube 21 is diameter-reduced radially inwardly, thereby fixing the axial rod 30 while the seal member 80 is held between the inner circumferential surface 27 of the rear end portion 26 of the sheath tube 21 and the outer circumferential surface of the axial rod 30. In the present embodiment, an inside diameter F shown in FIG. 2 of the rear end portion 26 of the sheath tube 21 as measured after the diameter-reducing work and the outside diameter C shown in FIG. 5 of the small-diameter portion 90 of the seal member 80 as measured before the diameter-reducing work satisfy a relation $F<C$. Thus, in a condition where at least the rear end portion 26 of the sheath tube 21 is diameter-reduced, the seal member 80 is radially squeezed such that the outer circumferential surface of the small-diameter portion 90 and the inner circumferential surface of the rear end portion 26 of the sheath tube 21 are in close contact with each other; thus, the magnesia powder 22 can be reliably sealed. Also, when the seal member 80 is radially squeezed, the large-diameter portion 85 is deformed to a greater extent. However, by means of the relation $M<L1+L2$ being satisfied as mentioned above, there can be rendered small the percentage of the seal member 80 accounted for by a portion of the seal member 80 which is deformed greatly as compared with deformation of the entire seal member 80. That is, an increase in internal stress of the seal member 80 associated with deformation can be restrained, so that a sealed condition can be maintained stably.

Figure 6:
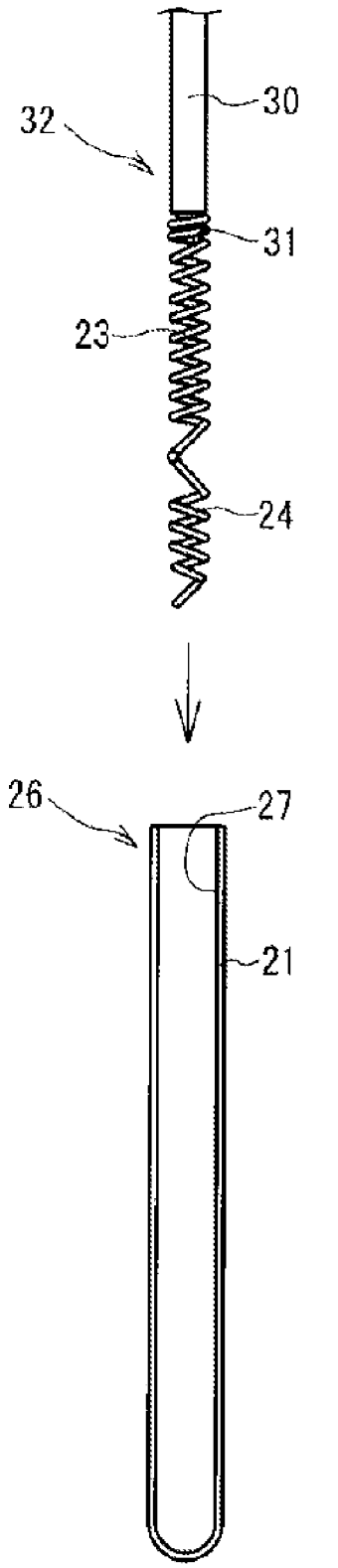
FIG. 6 is a schematic view illustrating a disposing step in the process of manufacturing the glow plug.
Figure 7:
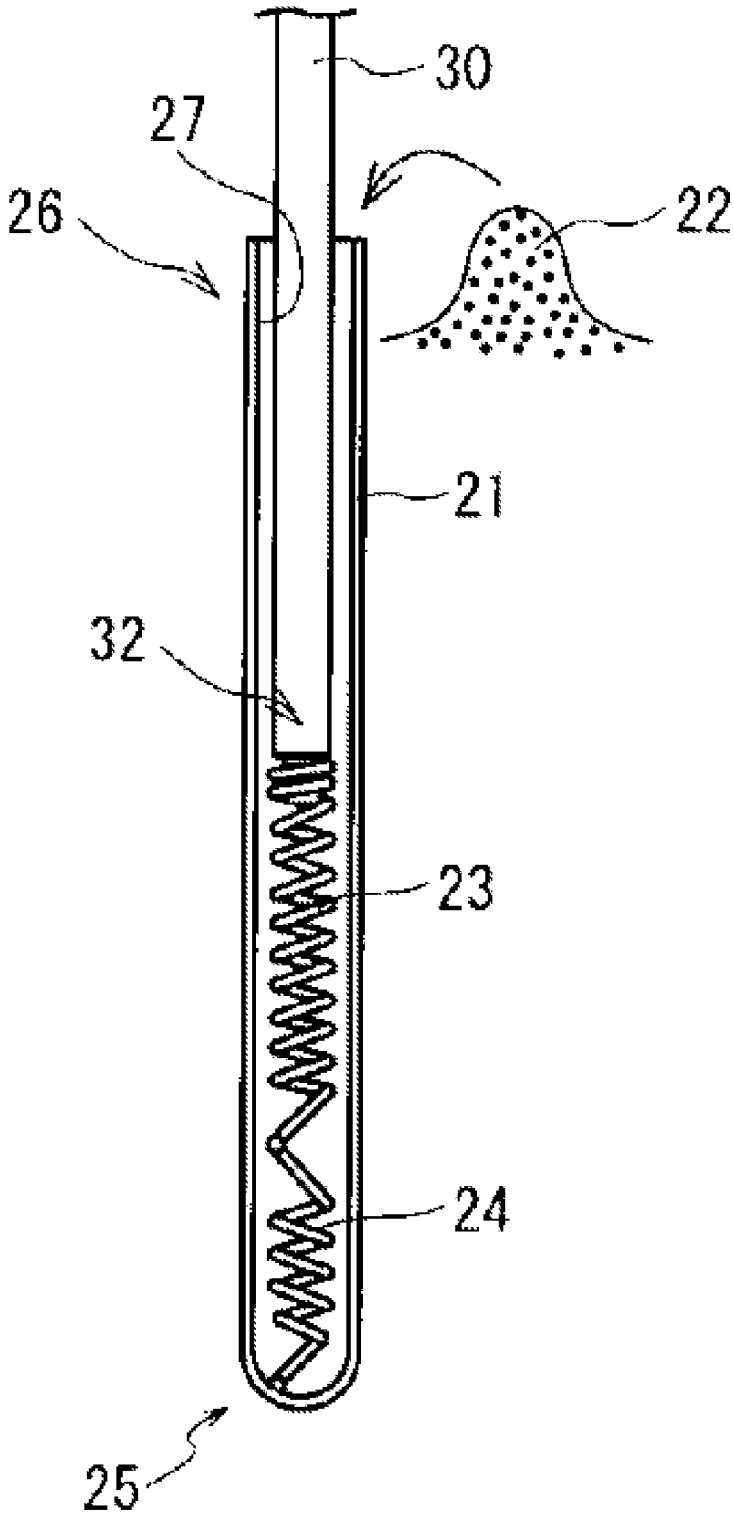
FIG. 7 is a schematic view illustrating a charging step in the process of manufacturing the glow plug.
Figure 8:
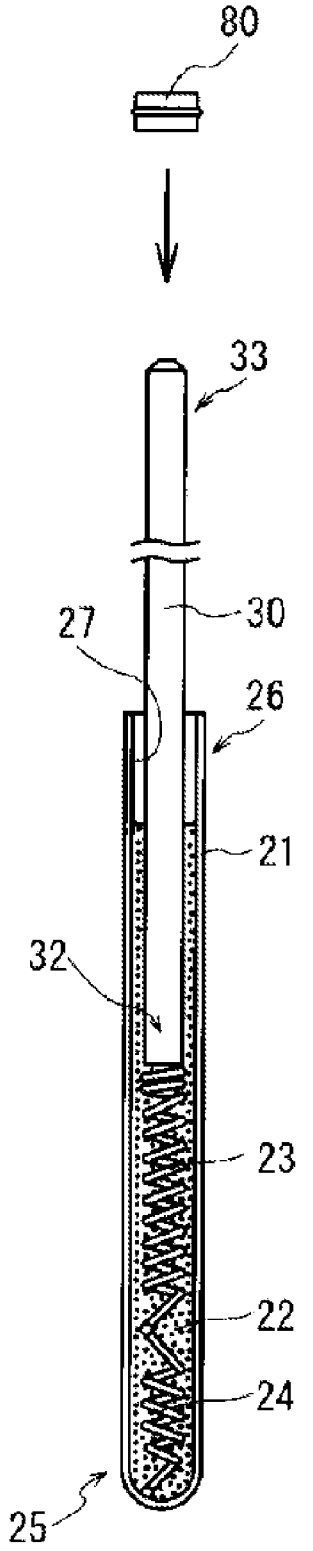
FIG. 8 is a schematic view illustrating a moving step in the process of manufacturing the glow plug.
Figure 9:
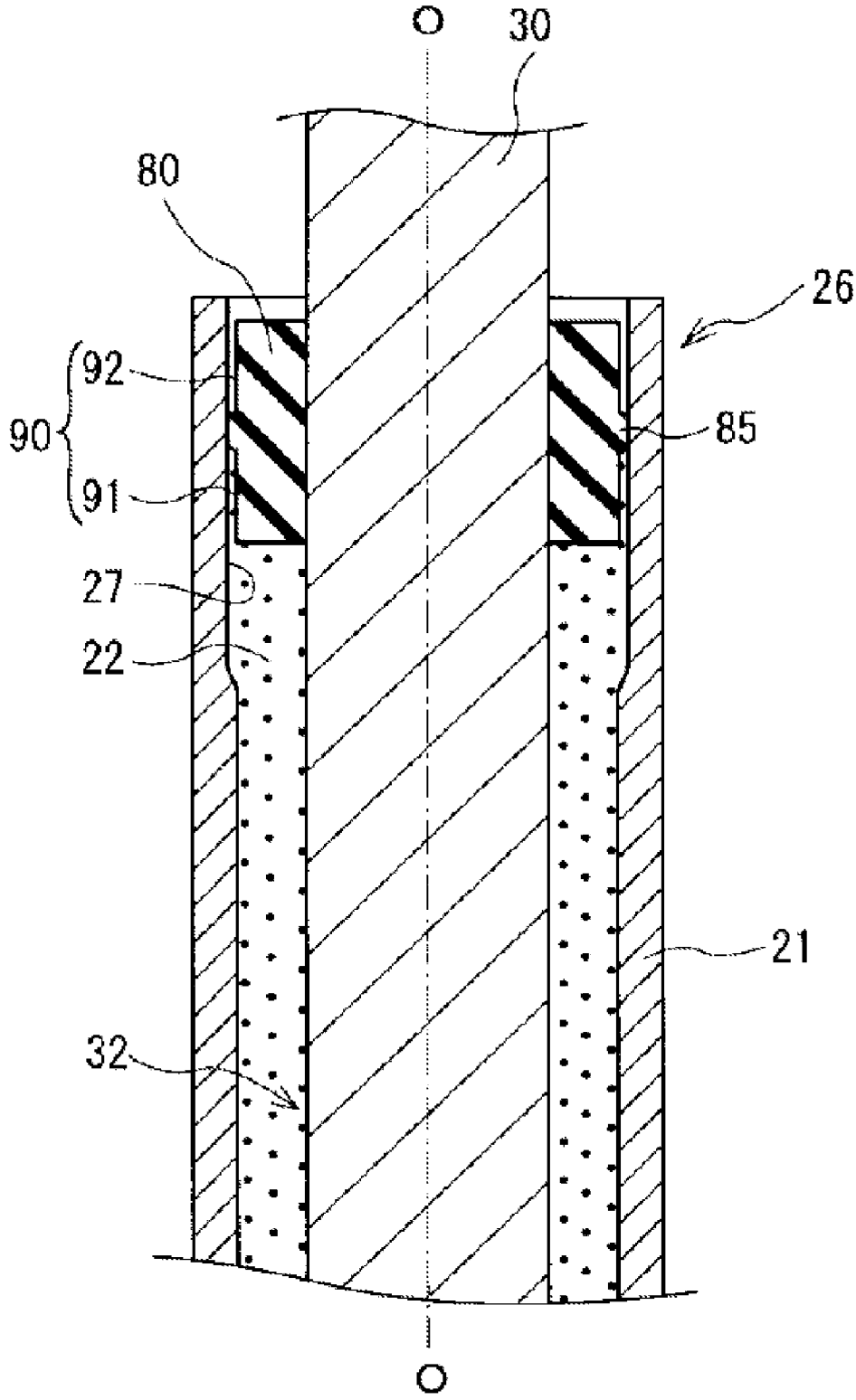
FIG. 9 is a schematic view of the seal member inserted into a sheath tube of the glow plug following a fitting step in the process of manufacturing the glow plug.
Figure 10:
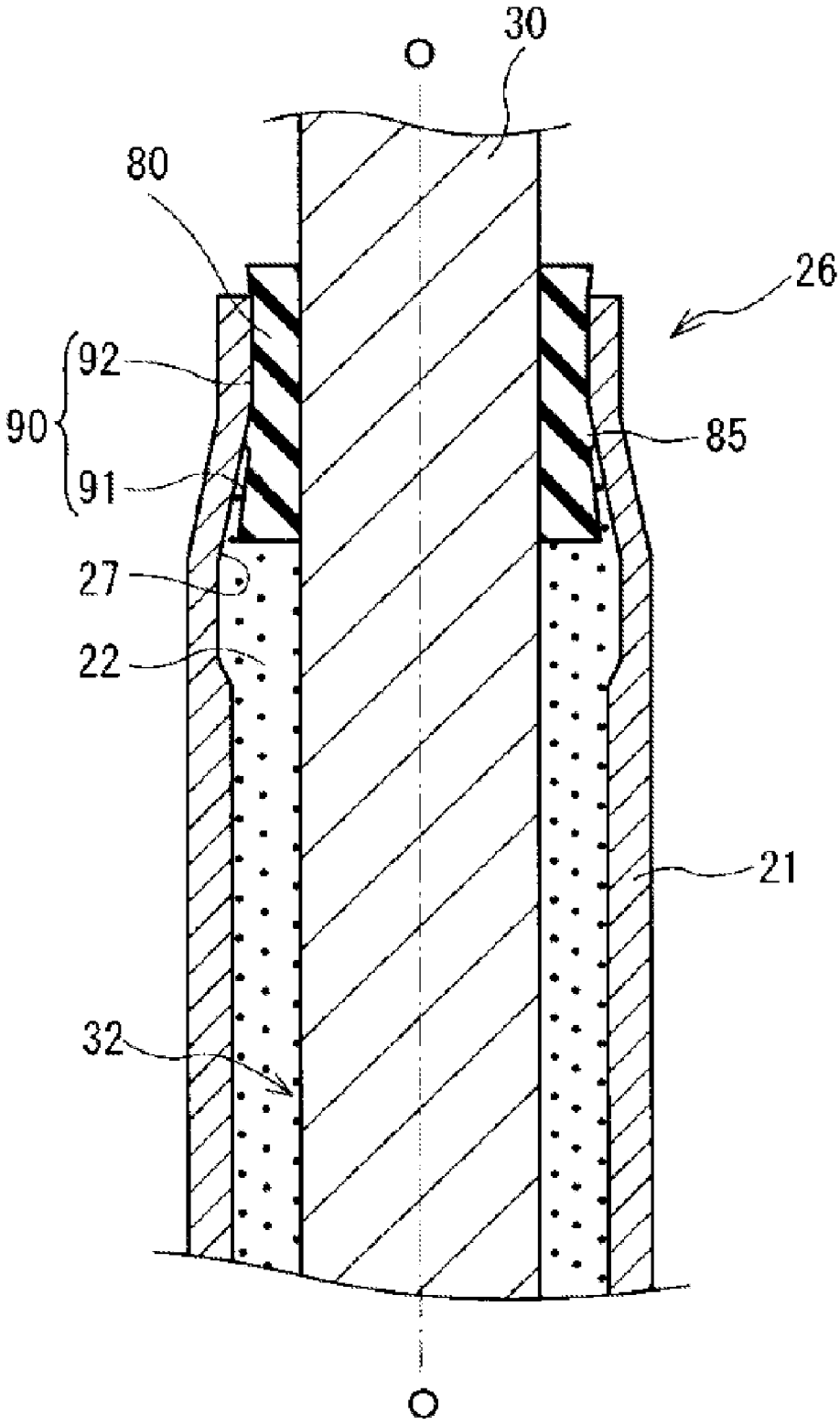
FIG. 10 is a schematic view of the seal member and the sheath tube following a diameter-reducing step in the process of manufacturing the glow plug.

By virtue of the above-mentioned prescription of the relation of dimensional magnitude between the large-diameter portion 85 and the small-diameter portion 90 of the seal member 80, in the glow plug 100 which is manufactured by the following method, the magnesia powder 22 charged into the sheath tube 21 can be reliably sealed. The process of manufacturing the glow plug 100 will be described below. In description of the manufacturing process, steps for manufacturing the sheath heater 20 are described in detail with reference to FIGS. 6 to 10, and other steps are omitted or described briefly. FIG. 6 schematically shows a disposing step in the process of manufacturing the glow plug 100. FIG. 7 schematically shows a charging step in the process of manufacturing the glow plug 100. FIG. 8 schematically shows a moving step in the process of manufacturing the glow plug 100. FIG. 9 schematically shows a fitting step in the process of manufacturing the glow plug 100. FIG. 10 schematically shows a diameter-reducing step in the process of manufacturing the glow plug 100.

According to the process of manufacturing the glow plug 100 shown in FIG. 1, in fabrication of the sheath heater 20, first, one (front) electrode of the control coil 23 is joined in series to a rear electrode of the heat-generating coil 24, and the other (rear) electrode of the control coil 23 is fitted to and welded to the engagement portion 31 of the axial rod 30. As shown in FIG. 6, the heat-generating coil 24, the control coil 23, and a front end portion of the axial rod 30 are inserted into the sheath tube 21 sequentially starting from the heat-generating coil 24, and then one (front) electrode of the heat-generating coil 24 is welded to the inner surface of the front end portion 25 of the sheath tube 21 (disposing step).

Next, as shown in FIG. 7, while the heat-generating coil 24, the control coil 23, and the axial rod 30 are pulled along the direction of the axis O, the magnesia powder 22 is charged into the sheath tube 21 from an opening of the rear end portion 26 of the sheath tube 21 (charging step). After the charging step, a pressing jig (not shown) is inserted into the sheath tube 21 from the opening of the rear end portion 26 of the sheath tube 21 so as to compact frontward the magnesia powder 22 charged into the sheath tube 21. Then, as shown in FIG. 8, the axial rod 30 is inserted from its rear end portion 33 into the insertion hole 81 of the seal member 80, and then the seal member 80 is moved toward the front end portion 32 of the axial rod 30 (moving step).

Next, as shown in FIG. 9, the seal member 80 is fitted into the sheath tube 21 from the opening of the rear end portion 26 of the sheath tube 21. As shown in FIG. 5, the outside diameter C of the small-diameter portion 90 (here, the front-end small-diameter portion 91) is smaller than the inside diameter A of the rear end portion 26 of the sheath tube 21. Thus, at the beginning of the fitting work, the seal member 80 is less likely to be caught by a rear-end opening portion of the sheath tube 21. Also, in the course of the fitting work, the seal member 80 can be readily pushed into the sheath tube 21 until the large-diameter portion 85 of the seal member 80 comes into contact with the rear end of the sheath tube 21. By virtue of elasticity of the seal member 80, when the large-diameter portion 85 comes into contact with the rear end of the sheath tube 21, pushing the seal member 80 further into the sheath tube 21 causes the large-diameter portion 85 to be contracted radially and received within the rear end portion 26 of the sheath tube 21. In this condition, pushing the seal member 80 further into the sheath tube 21 causes the fitting work to proceed such that the large-diameter portion 85 frictionally slides on the inner circumferential surface 27 of the sheath tube 21. Meanwhile, the seal member 80 has the small-diameter portion 90 as well as the large-diameter portion 85, and the length (range) M which the large-diameter portion 85 occupies along the direction of the axis P is smaller than the length (range) $L1+L2$ which the small-diameter portion 90 occupies along the direction of the axis P. Thus, contact resistance between the seal member 80 and the inner circumferential surface 27 associated with the fitting work can be sufficiently lowered, whereby the fitting work can be facilitated. Further, the large-diameter portion 85 can scrape off the magnesia powder 22 which might adhere to the inner circumferential surface 27 of the sheath tube 21, thereby restraining the presence of the magnesia powder 22 remaining between the inner circumferential surface 27 and the rear-end small-diameter portion 92, which is located rearward (with respect to a fitting direction) of the large-diameter portion 85 (fitting step).

The rear end portion 26 of the sheath tube 21 into which the seal member 80 is fitted is crimped (deformed) radially inwardly, thereby sealing the interior of the sheath tube 21 and holding the axial rod 30 in position. Subsequently, the rear end portion 26 of the sheath tube 21 is externally subjected to swaging. As shown in FIG. 10, swaging is carried out gradually from the rear end of the sheath tube 21 toward the front end of the sheath tube 21, whereby the sheath tube 21 is diameter-reduced (diameter-reducing step). In association with diameter reduction of the rear end portion 26 of the sheath tube 21, the magnesia powder 22 charged into the sheath tube 21 is pushed rearward and intrudes into a clearance between the inner circumferential surface 27 of the sheath tube 21 and the front-end small-diameter portion 91 of the seal member 80. Further, as swaging proceeds, the magnesia powder 22 moves along the clearance toward the rear-end small-diameter portion 92; however, further rearward movement of the magnesia powder 22 is checked by the large-diameter portion 85 in close contact with the inner circumferential surface 27. Thus, the magnesia powder 22 does not reach an interface between the inner circumferential surface 27 and the rear-end small-diameter portion 92. Notably, FIG. 10 shows a state at a certain point of time in the diameter-reducing step, showing how the large-diameter portion 85 checks the movement of the magnesia powder 22 toward the rear-end small-diameter portion 92.

As shown in FIG. 2, in a state after completion of swaging, the seal member intervenes in a radially squeezed condition between the inner circumferential surface 27 of the sheath tube 21 and the outer circumferential surface of the axial rod 30. In this condition, the outside diameter B of the large-diameter portion 85, together with the outside diameter C of the small-diameter portion 90, becomes substantially identical with the inside diameter F of the rear-end portion 26 as measured after the diameter-reducing step, whereby the seal member 80 comes in close contact with the inner circumferential surface 27. The magnesia powder 22 is confined within the sheath tube 21 in a sealed condition. Also, the magnesia powder 22 may be present in an interface between the inner circumferential surface 27 and the front-end small-diameter portion 91, but is not present in an interface between the inner circumferential surface 27 and the rear-end small-diameter portion 92. Thus, moisture in an ambient atmosphere does not enter the sheath tube 21 through the magnesia powder 22.

By this procedure, the sheath heater 20 which holds the axial rod 30 is completed, and then, as shown in FIG. 1, the sheath heater 20 is inserted into the axial bore 43 of the metallic shell 40 from the front end of the metallic shell 40 so as to hold the rear end portion 26 of the sheath heater 20 within the axial bore 43. The axial rod 30 extends through the axial bore 43 of the metallic shell 40, and the rear end portion 33 of the axial rod 30 projects rearward from the rear end of the metallic shell 40. The O-ring 7 and the insulation ring 50 are fitted from the rear end portion 33 of the axial rod 30 and are received in the axial bore 43 of the metallic shell 40. Further, the pin terminal 60 is fitted to the rear end portion 33 of the axial rod 30 and is then fixed by crimping. The glow plug 100 thus is completed.

Figure 11:
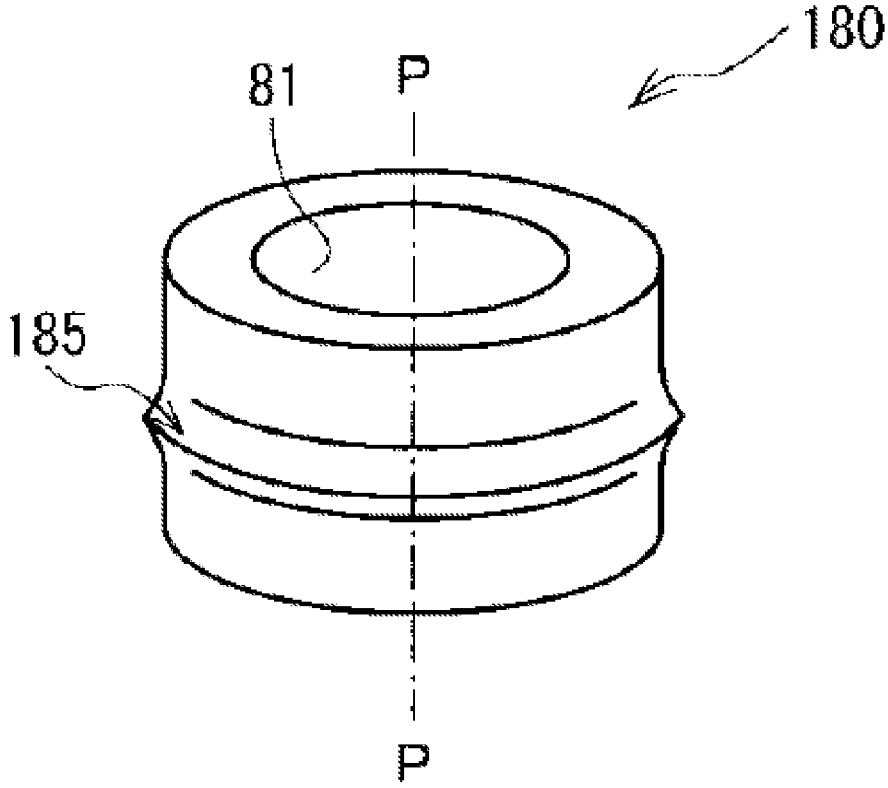
FIG. 11 is a perspective view of another modified seal member in a condition before being assembled to a glow plug.

Meanwhile, the present invention can be modified in various forms. For example, as in the case of a seal member 180 shown in FIG. 11, a projecting end of a large-diameter portion 185 may be steeply ridged. Further, the width of the large-diameter portion 185 along the direction of the axis O may be widened. This can impart sufficient strength to the large-diameter portion 185, thereby lowering risk of occurrence of chipping or like defect on the large-diameter portion 185 in the fitting step.

Figure 12:
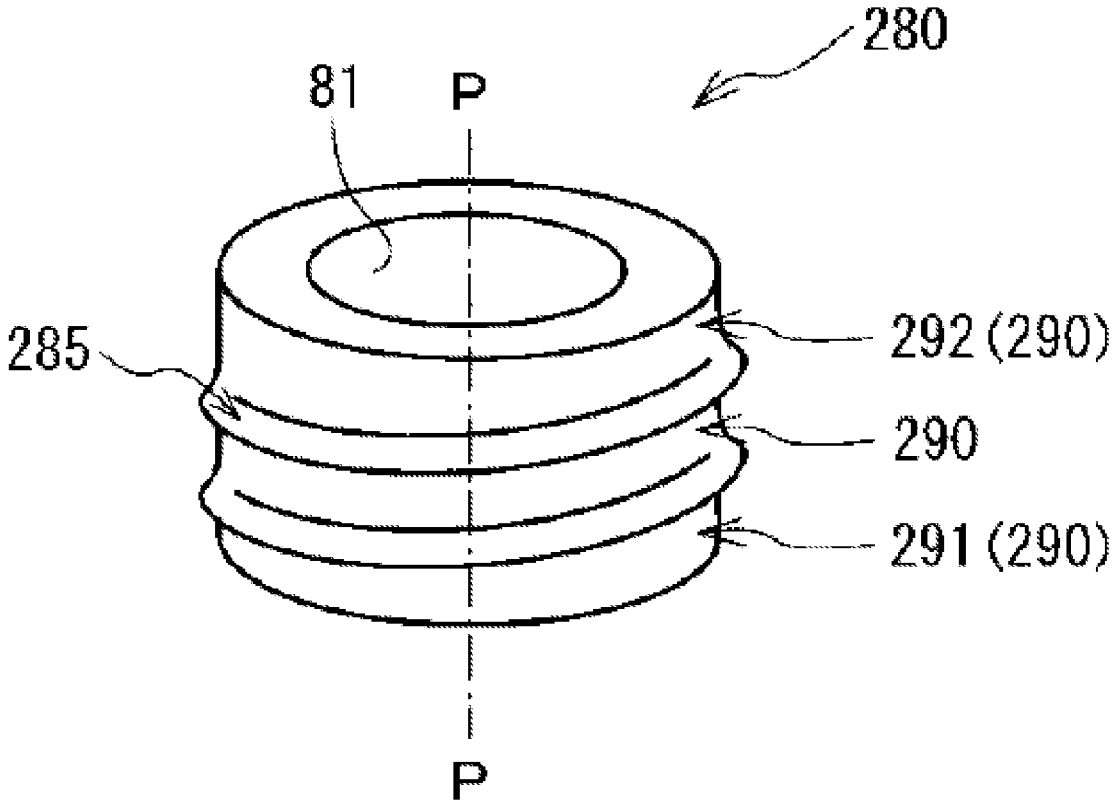
FIG. 12 is a perspective view of yet another modified seal member in a condition before being assembled to a glow plug.

Also, as in the case of a seal member 280 shown in FIG. 12, a large-diameter portion 285 may be formed spirally on and around the outer circumferential surface of the seal member 280. Even in this case, similarly to the present embodiment, a small-diameter portion 290 has a front-end small-diameter portion 291, whereby insertion of the seal member 280 can be facilitated by, in the fitting step, inserting the seal member 280 from the front-end small-diameter portion 291 into the sheath tube 21. Further, the small-diameter portion 290 has a rear-end small-diameter portion 292. By virtue of this, similarly to the present embodiment, when the seal member 280 is to be inserted into the sheath tube 21 in the fitting step, insertion from the front-end small-diameter portion 291 and insertion from the rear-end small-diameter portion 292 yield the same effect. This eliminates the trouble of orienting the seal member 280 in a manufacturing process.

Figure 13:
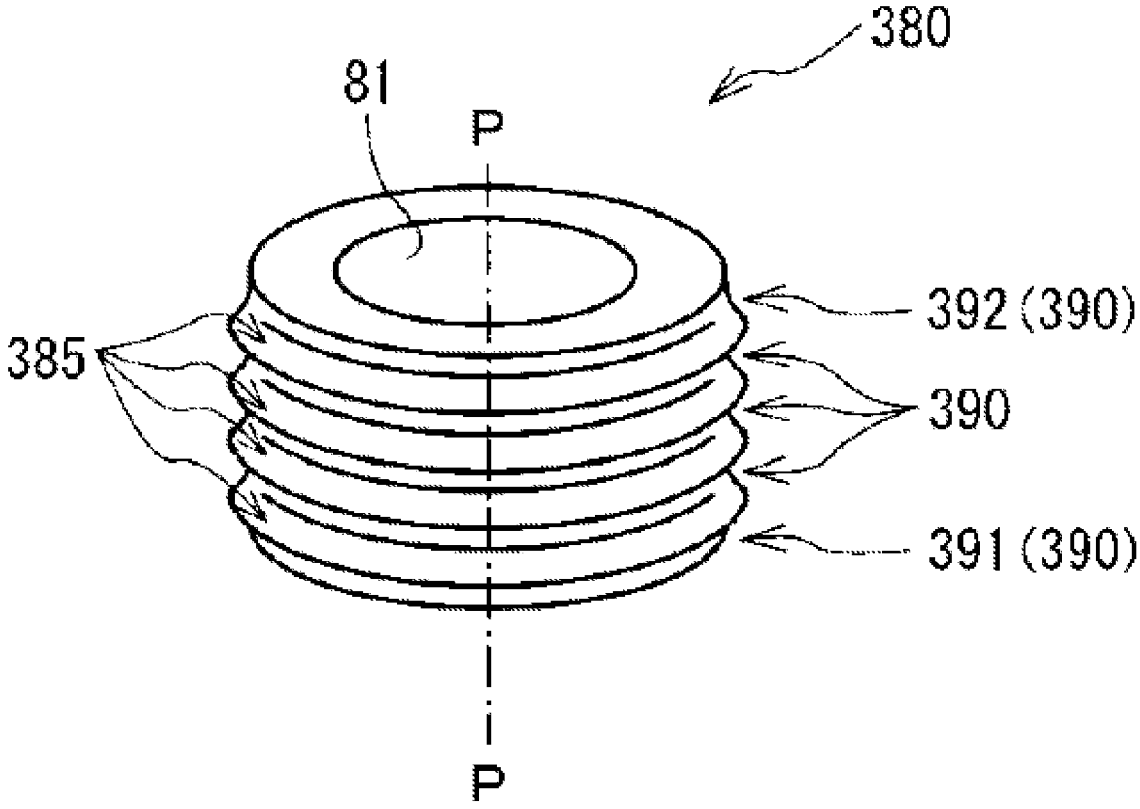
FIG. 13 is a perspective view of yet another modified seal member in a condition before being assembled to a glow plug.

Also, as in the case of a seal member 380 shown in FIG. 13, a plurality of large-diameter portions 385 and small-diameter portions 390 may be alternatingly arranged, thereby forming a so-called bellows form. Even in this case, the small-diameter portions 390 include a front-end small-diameter portion 391 and a rear-end small-diameter portion 392. Further, although unillustrated, the large-diameter portions may be in the form of ridges in relation to the small-diameter portions, or the small-diameter portions may be in the form of grooves in relation to the large-diameter portions.

Figure 14:
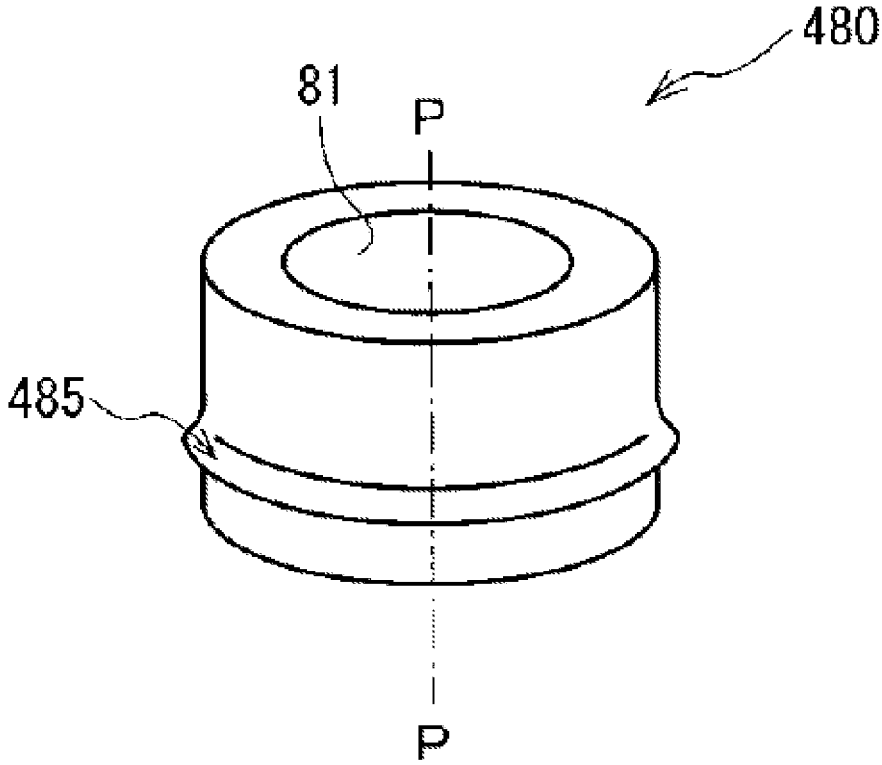
FIG. 14 is a perspective view of yet another modified seal member in a condition before being assembled to a glow plug.

Also, as in the case of a seal member 480 shown in FIG. 14, a large-diameter portion 485 may be biased frontward with respect to the direction of the axis P. Alternatively, although unillustrated, the large-diameter portion 485 may be biased rearward with respect to the direction of the axis P.

Figure 15:
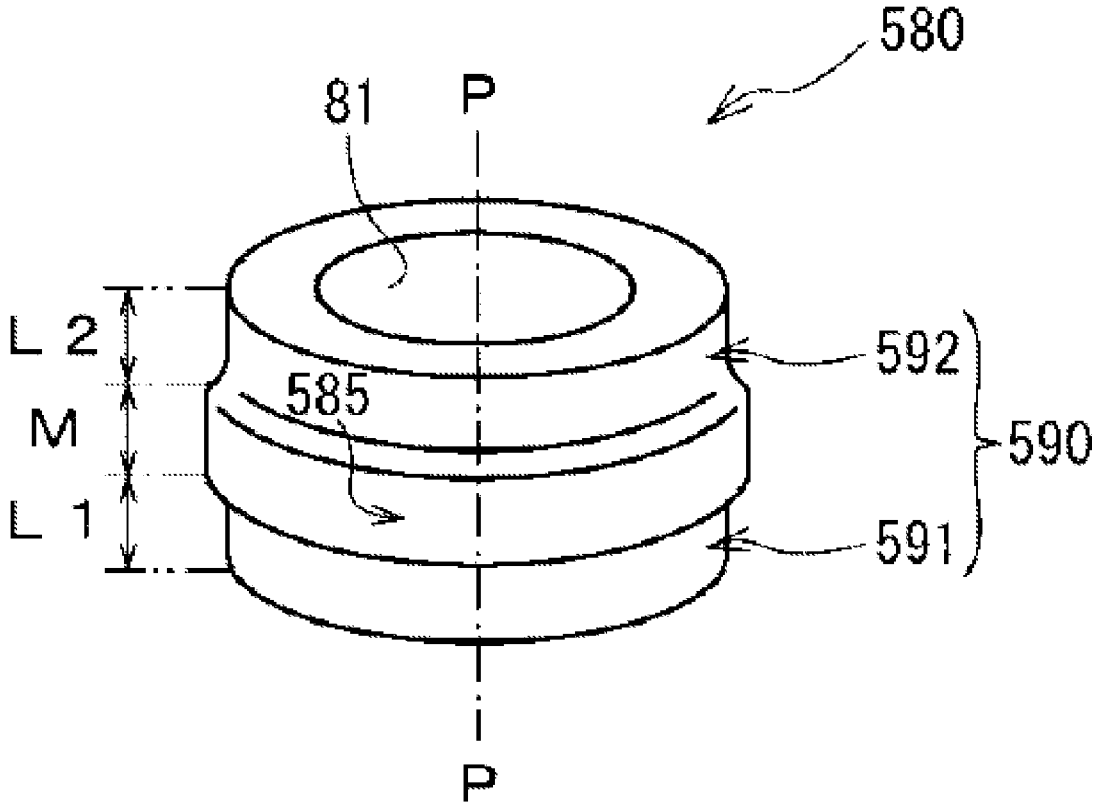
FIG. 15 is a perspective view of yet another modified seal member in a condition before being assembled to a glow plug.

Also, as in the case of a seal member 580 shown in FIG. 15, the length (range) M which the large-diameter portion 585 occupies along the direction of the axis P may be increased so as to more reliably scrape off the magnesia powder 22 which might adhere to the inner circumferential surface 27 of the sheath tube 21, and to enhance the condition of close contact, after the diameter-reducing step, between the seal member 580 and the inner circumferential surface 27 of the sheath tube 21. Even in this case, preferably, with respect to the direction of the axis P, the length (range) M which the large-diameter portion 585 occupies, and the length (range) L1+L2 which a small-diameter portion 590 occupies (L1: length (range) occupied by a front-end small-diameter portion 591; L2: length (range) occupied by a rear-end small-diameter portion 592) satisfy the relation $M<L1+L2$.

Figure 16:
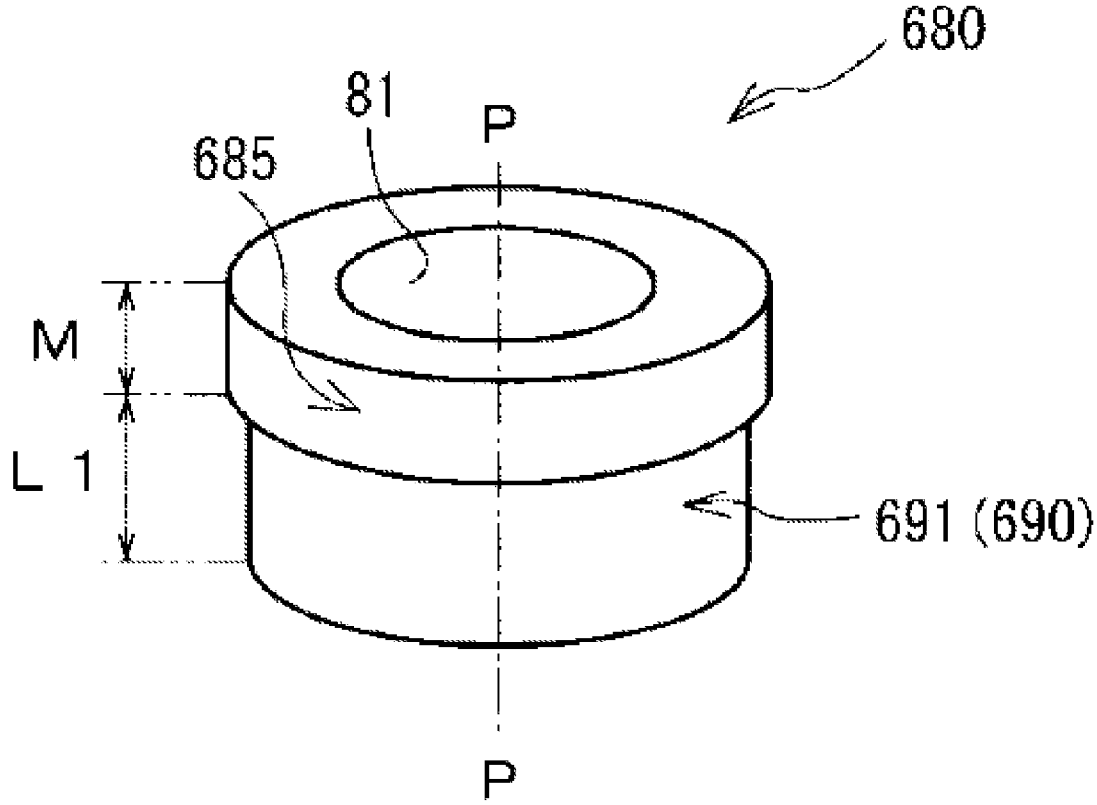
FIG. 16 is a perspective view of yet another modified seal member in a condition before being assembled to a glow plug.

Also, as in the case of a seal member 680 shown in FIG. 16, a large-diameter portion 685 may be provided flush with the rear end of the seal member 680; thus, a small-diameter portion 690 has only a front-end small-diameter portion 691 without having a rear-end small-diameter portion. Even in this case, insertion of the seal member 680 can be facilitated by employing the following dimensional relation: the length (range) L1 which the front-end small-diameter portion 691 occupies along the direction of the axis P is greater than the length (range) M which the large-diameter portion 585 occupies along the direction of the axis P.

Figure 17:
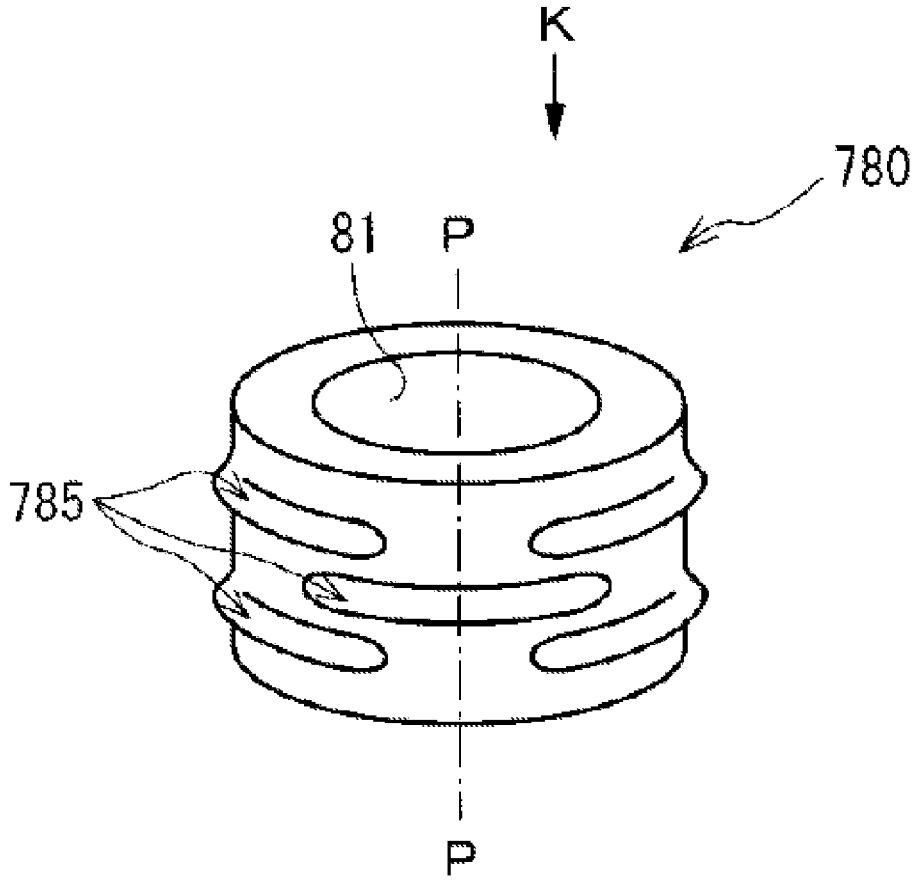
FIG. 17 is a perspective view of yet another modified seal member in a condition before being assembled to a glow plug.
Figure 18:
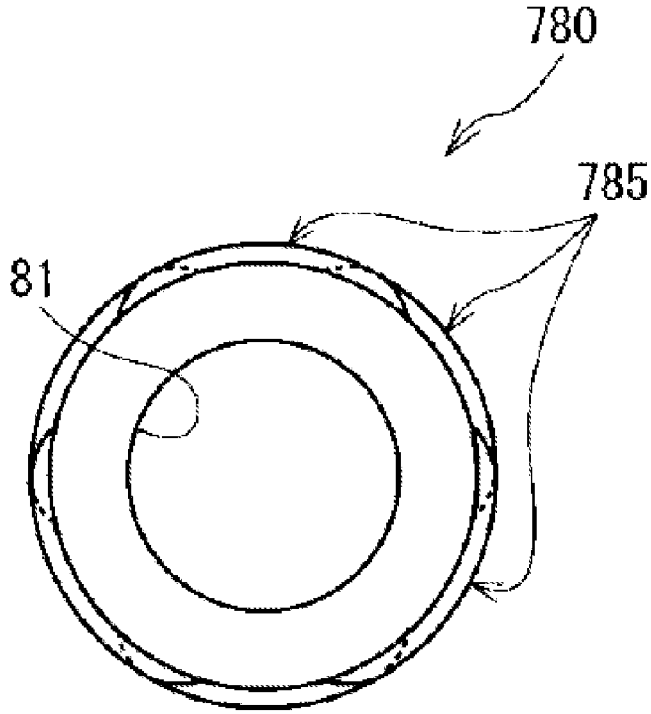
FIG. 18 is a view of the seal member of FIG. 17 as viewed in the direction of an arrow K along the direction of the axis P of the insertion hole of the seal member.

Also, as in the case of a seal member 780 shown in FIG. 17, a large-diameter portion 785 may not be continuous along the circumferential direction of a seal member 780. Preferably, in the fitting step, the large-diameter portion 785 can reliably scrape off the magnesia powder 22 which might adhere to the inner circumferential surface 27 of the sheath tube 21. Further, preferably, in the diameter-reducing step, the large-diameter portion 785 can check movement of the magnesia powder 22 contained in the sheath tube 21 and pushed rearward, so as to prevent the magnesia powder 22 from reaching at least an interface between the inner circumferential surface 27 and a rear-end small-diameter portion 792. For this purpose, as shown in FIG. 18, small segments which constitute the large-diameter portion 785 of the seal member 780 are arranged in an overlapping manner as viewed in the direction of the axis P, whereby the contours of the large-diameter portion 785 are circumferentially continuous along the entire circumference of the seal member 780.

In the present embodiment, in the diameter-reducing step, swaging is performed on the entire sheath tube 21. However, swaging may be performed only on the rear-end portion 26 of the sheath tube 21.

The present invention can be applied to a glow plug for an internal combustion engine and to a household electric heater, the glow plug and the heater using a sheath heater fabricated such that a sheath tube which contains a heat-generating coil is filled with an insulating powder.

DESCRIPTION OF REFERENCE NUMERALS

20: sheath heater
21: sheath tube
22: magnesia powder
24: heat-generating coil
25: front end portion
26: rear end portion
30: axial rod
31: engagement portion
80: seal member
81: insertion hole
85: large-diameter portion
90: small-diameter portion
100: glow plug

What is claimed is:

1. A glow plug having a sheath heater, the sheath heater comprising:

a sheath tube extending in an axial direction and having a tubular shape, a closed front end portion, and an open rear end portion;

a heat-generating resistor disposed within the sheath tube;

an insulating powder charged into a gap between the sheath tube and the heat-generating resistor; and a seal member received in said sheath tube and having a substantially cylindrical shape, the seal member including an expanded portion extending radially outwardly from an outer circumference of the seal member at least prior to receipt of said seal member in said sheath tube, and a non-expanded portion of a smaller outside diameter than the expanded portion at least prior to receipt of said seal member in said sheath tube, and formed on the outer circumference of the seal member at least at a leading end of the seal member;

the seal member being fitted into the open rear end portion of the sheath tube such that the leading end enters the sheath tube first, and the sheath tube being deformed radially inwardly around the seal member for sealing the heat-generating resistor and the insulating powder contained in the sheath tube; and the sheath heater generating heat through conduction of electricity to the heat-generating resistor.

2. A glow plug according to claim 1, wherein the expanded portion is circumferentially continuous on the outer circumference of the seal member, thereby assuming an annular form.

3. A glow plug according to claim 1, wherein the expanded portion and the non-expanded portion are formed on the outer circumference of the seal member such that a shape of the seal member has mutually corresponding regions on axially opposite sides of an axially central position of the seal member with respect to the axial direction.

4. A glow plug according to claim 1, wherein a distance which the non-expanded portion occupies along the outer circumference of the seal member in an axial direction is greater than another distance which the expanded portion occupies along the outer circumference of the seal member in the axial direction.

5. A method of manufacturing a glow plug according to claim 1, comprising:

a charging step of charging the insulating powder into the sheath tube from the open rear end portion of the sheath tube, where the heat-generating resistor is disposed within the sheath tube, the open rear end portion having an inside diameter A;

a fitting step of inserting the seal member into the sheath tube from the open rear end portion of the sheath tube, the expanded portion having an outside diameter B, the non-expanded portion having an outside diameter C, wherein $C<A<B$, such that the expanded portion frictionally slides on an inner circumferential surface of the open rear end portion of the sheath tube; and a diameter-reducing step of deforming at least the open rear end portion of the sheath tube radially inwardly so as to render the inside diameter A of the open rear end portion smaller than the outside diameter C of the non-expanded portion of the seal member.

6. A method of manufacturing a glow plug according to claim 5, wherein the seal member has an insertion hole extending through the seal member along an axial direction and having a diameter smaller than a diameter of an axial rod, for allowing the axial rod to be inserted through the insertion hole, the axial rod being a conductive rod extending in the axial direction and adapted to conduct electricity to the heat-generating resistor; the method further comprising:

a disposing step performed before the charging step of disposing the heat-generating resistor and a front end portion of the axial rod within the sheath tube the front end portion of the axial rod, being electrically connected to a rear end of the heat-generating resistor, and a moving step performed between the charging step and the fitting step of inserting a rear end of the axial rod through the insertion hole of the seal member and moving the seal member toward the front end portion of the axial rod; and as measured after the moving step and before the fitting step, the inside diameter A of the open rear end portion of the sheath tube whose diameter has not yet been reduced, the outside diameter B of the expanded portion of the seal member, and the outside diameter C of the non-expanded portion of the seal member satisfy a relation $C<A<B$.

7. A method of manufacturing a glow plug, comprising:

a charging step of charging an insulating powder into a sheath tube from an opening of a rear end portion of the sheath tube, where a heat-generating resistor is disposed within the sheath tube, the rear end portion of the sheath tube having an inside diameter A;

a fitting step of inserting a seal member having elastic properties into the sheath tube from the opening of the rear end portion of the sheath tube, the seal member including an expanded portion extending radially outwardly from an outer circumference of the seal member, and a non-expanded portion formed on the outer circumference of the seal member at least at a leading end of the seal member, wherein, at least prior to inserting the seal member into the sheath tube, the expanded portion has an outside diameter B and the non-expanded portion has an outside diameter C, wherein $C<A<B$, such that the expanded portion frictionally slides on an inner circumferential surface of the rear end portion of the sheath tube; and a diameter-reducing step of deforming at least the rear end portion of the sheath tube radially inwardly so as to render the inside diameter A of the rear end portion smaller than the outside diameter C of the non-expanded portion of the seal member.

8. The method of manufacturing a glow plug of claim 7, wherein the seal member has an insertion hole extending through the seal member along an axial direction and having a diameter smaller than a diameter of an axial rod, for allowing the axial rod to be inserted through the insertion hole, the axial rod being a conductive rod extending in the axial direction and adapted to conduct electricity to the heat-generating resistor; the method further comprising:

a disposing step performed before the charging step of disposing the heat-generating resistor and a front end portion of the axial rod within the sheath tube, the front end portion of the axial rod being electrically connected to a rear end of the heat-generating resistor, and a moving step performed between the charging step and the fitting step of inserting a rear end of the axial rod through the insertion hole of the seal member and moving the seal member toward the front end portion of the axial rod; and as measured after the moving step and before the fitting step, the inside diameter A of the rear end portion of the sheath tube whose diameter has not yet been reduced, the outside diameter B of the expanded portion of the seal member, and the outside diameter C of the non-expanded portion of the seal member satisfy a relation $C<A<B$.

* * * * *